United States Patent [19]

King

[11] 4,348,294

[45] Sep. 7, 1982

[54] ONE PACKAGE REPLENISHER FOR ALUMINUM CLEANER

[75] Inventor: Peter F. King, Farmington Hills, Mich.

[73] Assignee: Occidental Chemical Corporation, Warren, Mich.

[21] Appl. No.: 163,365

[22] Filed: Jun. 26, 1980

[51] Int. Cl.[3] ..... C11D 1/72; C11D 7/08

[52] U.S. Cl. ..... 252/142

[58] Field of Search ..... 252/142; 134/3, 40, 134/41

[56] References Cited

U.S. PATENT DOCUMENTS 3,969,135 7/1976 King et al. ..... 134/41

*Primary Examiner*—John E. Kittle

*Attorney, Agent, or Firm*—Richard P. Mueller; Arthur E. Kluegel

[57] ABSTRACT

Disclosed is a one package cleaning solution replenisher concentrate having good temperature stability characteristics. The replenisher concentrate is a temperature stable aqueous acidic solution comprising a polyalkylene glycol-abietic acid surfactant, a polyalkylene glycol-hydrocarbon surfactant, and at least 2% fluoride and is well adapted to replenish a working bath of cleaning solution to maintain the activity thereof.

2 Claims, No Drawings

ONE PACKAGE REPLENISHER FOR ALUMINUM CLEANER

BACKGROUND OF THE INVENTION

The present invention relates to replenishers for cleaning compositions intended for use in cleaning aluminum surfaces. More particularly, the present invention relates to an aqueous replenisher which has good temperature stability characteristics to facilitate shipping and storage and which is well adapted to replenish a cleaning composition for cleaning aluminum surfaces.

During cold forming of aluminum an organic lubricant is generally applied to the aluminum surfaces to facilitate the forming operation. A residue of the lubricant remains on the surface after forming is completed and must be removed in a cleaning operation for some uses of the aluminum. A particularly useful cleaning composition for this purpose is that taught in U.S. Pat. No. 3,969,135, July 13, 1976, to King et al. In accordance with the King et al. patent, aluminum surfaces can be cleaned under low temperature conditions by an aqueous acidic cleaning composition containing a polyalkylene glycol-abietic acid surfactant and a polyalkylene glycol-hydrocarbon surfactant. The composition also preferably contains fluoride. Extended use of the King et al. composition in a working bath, however, requires replenishment of the active ingredients therein; and it has been found that under certain line conditions, a fixed ratio of surfactants to fluoride can be maintained by addition of a single package replenisher to the working solution where the replenisher comprises a concentrate of surfactants and fluoride. However, it has been found that a replenisher solution containing the surfactants of King et al. and fluoride are subject to phase separation under the temperature conditions likely to be encountered during shipping and storage. It would be desirable if a temperature stable concentrate replenisher could be provided which could be shipped and/or stored without phase separation and added to the working solution to replenish the low temperature aluminum cleaning composition of the King et al. patent.

SUMMARY OF THE INVENTION

A temperature stable, one package replenisher adapted to replenish a cleaning composition for cleaning an aluminum surface, comprises an aqueous, acidic solution containing a polyalkylene glycol-hydrocarbon surfactant, a polyalkylene glycol-abietic acid surfactant, and at least 2% fluoride.

DETAILED DESCRIPTION OF THE INVENTION

In accordance with the present invention an aqueous based concentrate is provided which is well adapted to replenish a low temperature aluminum cleaning composition of U.S. Pat. No. 3,969,135 which issued July 13, 1976, to King et al., which patent is specifically incorporated by a reference herein. It has been found that the replenisher of the present invention has good temperature stability characteristics and, hence, is suitable for storage and shipping under commercial conditions. In addition, the replenisher provides, in a single package, a replenisher solution for maintaining a working solution of the King et al. patent. More specifically, it has been found that an acidic aqueous replenisher containing a polyalkylene glycol-hydrocarbon surfactant and a polyalkylene glycol-abietic acid surfactant can, with good temperature stability, also contain fluoride in an effective fluoride concentration of from about 2% to about 15% by weight if the total surfactant concentration is between about 10% to about 20% by weight.

Of course, it will be appreciated that the replenisher of the present invention is intended to be added to an existing bath to replenish the working solution of the bath. The working solution to be replenished is that of the hereinbefore referenced King et al. patent. Preferably, the effective fluoride concentration in the working solution is from about 0.001 to about 0.01% by weight. Also preferably, each surfactant taught in the King et al. patent is present in an amount of from 0.05% to 0.21% by weight. To provide a replenisher of the present invention, of course, each ingredient must be present in a much greater concentration. In accordance with the present invention, a temperature stable replenisher is provided if the concentrations of the ingredients are within the aforementioned ranges.

The polyalklene glycol-hydrocarbon surfactant suitable for use in the replenisher of the present invention may be represented by the following general formula:

$$R(OR')_nOH$$

wherein R is an alkyl or alkylaryl group of 8–22 carbon atoms; R′ is a divalent radical selected from ethyl, propyl and combinations thereof and n is an integer from 7 to 22. Commercially available surfactants believed to fall within the above general formula include Triton CF-10 available from the Rohm and Haas Co., Antarox LF-330, Antarox BL-330, and Igepal CA 630 from the GAF Corporation, Trycol LF-1 from Emery Industries, Inc. and Plurafac D-25 from BASF Wyandotte Corp. These surfactants contain both alkyl and alkylaryl R groups, ethoxy and propoxy R′ groups with n values ranging from 8 to 16.

The polyalkylene glycol-abietic acid surfactant of the King et al. patent and suitable for use in the present invention may be represented by the general formula:

$$A(R'O)_nH$$

wherein R′ and n are as defined above and A is the abietic acid radical. Commercially available surfactants are Surfactant Ar 150 supplied by Hercules, Inc. and Pegosperse 700-TO supplied by Glyco Chemicals, Inc. Both of these commercially available surfactants serve as source of an abietic acid ester containing approximately 14 to 16 moles of ethoxylation.

It has been found that variations in the alkylene oxide end groups of either of the above surfactants does not adversely affect their efficacy. The final hydroxy group may be replaced, for example, by a chloride substituent. Alkyl or aryl substitutions may also be made.

To provide a stable replenisher, each surfactant must be present in an amount sufficient to provide a total surfactant concentration of from about 10% to about 20% by weight in the replenisher solution. The replenisher also comprises fluoride in a concentration of from about 2% to about 15% by weight. Any source of fluoride sufficient to provide the desired fluoride concentration may be used herein, however, the preferred source is hydrofluoric acid. It will be appreciated that each surfactant can be present in the same or somewhat different concentration with respect to the other so long as a substantial amount of each surfactant is present. In addition, a suitable mineral acid such as phosphoric or sulfuric acid must be employed in the replenisher to provide an acidic pH of less than 0. A mineral acid selected from the group consisting of phosphoric acid and sulfuric acid and mixtures thereof in a concentration of from about 25% to about 50% by weight is suitable for use herein.

The following example is provided to further illustrate the present invention.

EXAMPLE I

An acidic aqueous replenisher was prepared by mixing the following ingredients:

| Material | Parts by weight |
|---|---|
| Water | 40.48 |
| Sulfuric Acid 66° Be (96 wt. %) | 38.4 |
| Trycol LF-1 | 7.32 |
| Surfactant AR-150 | 7.32 |
| 70% HF | 6.48 |
| | 100 |

The replenisher is stable for an extended period of time at 120° F.

What is claimed is:

1. An aqueous acidic replenisher having good temperature stability and containing, as active ingredients, a polyalkylene glycol-abietic acid surfactant having the general formula:

$$A(R'O)_nH;$$

a polyalkylene glycol-hydrocarbon surfactant having the general formula:

$$R(OR')_nOH;$$

wherein:

R is an alkyl or alkylaryl group of 8–22 carbon atoms, each R′ is a divalent radical selected from ethylene, propylene and combinations thereof each n is an integer from 7 to 22, and A is the abietic acid radical; fluoride; and sulfuric acid, characterized by having said surfactants present in a combined concentration of from about 10 to about 20% by weight, said fluoride present in a concentration of from about 2 to about 15% by weight and said sulfuric acid present in a concentration of from about 25 to about 50% by weight and being further characterized by having the said active ingredients present in a combined concentration of from about 38 to about 68% by weight.

2. A replenisher as in claim 1 wherein each of said polyalkylene glycol-hydrocarbon surfactant and said polyalkylene glycol-abietic acid surfactant is present in about an equal concentration.

* * * * *